United States Patent [19]

Wixon

[11] 3,954,679

[45] May 4, 1976

[54] VISCOSITY REDUCTION OF AQUEOUS ALPHA-OLEFIN SULFONATE DETERGENT COMPOSITION

[75] Inventor: Harold Eugene Wixon, New Brunswick, N.J.

[73] Assignee: Colgate-Palmolive Company, New York, N.Y.

[22] Filed: Nov. 26, 1973

[21] Appl. No.: 419,160

[52] U.S. Cl. ..... 252/555; 252/527; 252/536; 252/546

[51] Int. Cl.[2] ..... C11D 1/14; C11D 3/065; C11D 11/02

[58] Field of Search ..... 252/555, 536; 260/513

[56] References Cited

UNITED STATES PATENTS

| | | | |
|---|---|---|---|
| 2,434,683 | 1/1948 | Buis et al. | 252/550 X |
| 3,632,515 | 1/1972 | Sharman | 252/95 |
| 3,640,880 | 2/1972 | Martin | 252/555 |
| 3,708,437 | 1/1973 | Sweeney | 252/555 |
| 3,741,915 | 6/1973 | Paviak | 252/555 |
| 3,816,352 | 6/1974 | Loureiro et al. | 252/556 |
| 3,852,221 | 12/1974 | Bentley | 252/548 |

FOREIGN PATENTS OR APPLICATIONS 983,056 2/1965 United Kingdom

OTHER PUBLICATIONS

Knaggs et al., "Alpha Olefin Sulfonates–New Cosmetic Sulfonates," Stepan Chem. Co., N. Ill., Dec. 1967, pp. 1–5, 10, 11 & 19.

*Primary Examiner*—P. E. Willis, Jr.
*Attorney, Agent, or Firm*—Raymond Kramer; Richard Miller; Herbert Sylvester

[57] ABSTRACT

The viscosity of an aqueous alpha-olefin sulfonate detergent composition is reduced by treating such composition, usually at a concentration of 30 to 60%, with a viscosity reducing proportion, usually from 2 to 20%, of a water soluble inorganic halide salt, preferably sodium chloride. By reducing the viscosity, detergent compositions containing the alpha-olefin sulfonate detergent are made more readily pourable, pumpable and sprayable, facilitating their use in liquid detergents and in spray dried particulate form. Because the addition of halide salt may cause separation into different phases it is possible to increase the concentration of the alpha-olefin sulfonate by utilizing the phase richer in content of such detergent material.

The viscosity reducing effect of the halide salt is utilizable in manufacturing the alpha-olefin detergent composition by thinning such composition in the neutralization, bleaching and other steps in its manufacture, thereby allowing the use of less water and facilitating an increase in detergent solids content of the final alpha-olefin sulfonate detergent compositions made.

23 Claims, 1 Drawing Figure

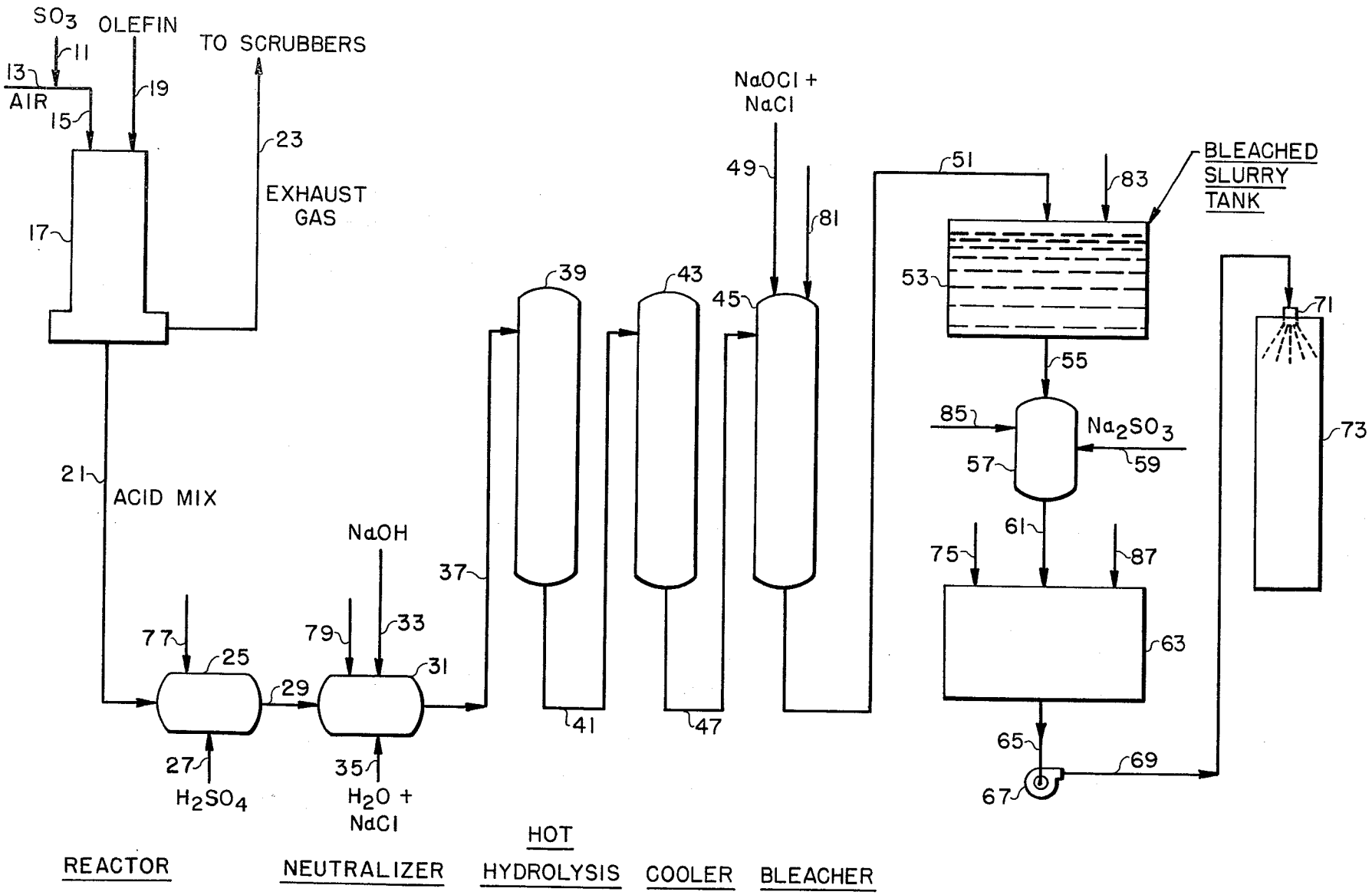
BLEACHED SLURRY TANK
$Na_2SO_3$
NaOCl + NaCl
TO SCRUBBERS
EXHAUST GAS
OLEFIN
$SO_3$
AIR
ACID MIX
NaOH
$H_2O$ + NaCl
$H_2SO_4$
REACTOR
NEUTRALIZER
HOT HYDROLYSIS
COOLER
BLEACHER
11
13
15
17
19
21
23
25
27
29
31
33
35
37
39
41
43
45
47
49
51
53
55
57
59
61
63
65
67
69
71
73
75
77
79
81
83
85
87

VISCOSITY REDUCTION OF AQUEOUS ALPHA-OLEFIN SULFONATE DETERGENT COMPOSITION

This invention is of a method of improving rheological properties of liquid compositions containing alpha-olefin sulfonate detergents. More particularly, it relates to processes for reducing the viscosities of such compositions by additions thereto of viscosity-reducing proportions of a particular type of water soluble salt.

Alpha-olefin sulfonates are well known detergent materials, especially useful as biodegradable detergents in household and industrial cleaning products. They have been employed or suggested for use in built and unbuilt liquid detergents, in heavy duty and light duty particulate detergents, such as spray dried products, and in detergent or soap-detergent bars for personal use. Although they are good detergents in such applications, they tend to gel in aqueous media at higher concentrations, e.g., above about 30%, and the gelled, thickened or viscous aqueous compositions are difficult to mix, pump, filter, pour and atomize. Accordingly, the detergents are normally employed at lower concentrations in aqueous media, below the gelation range. This requires the presence of a greater proportion of water with the alpha-olefin sulfonate detergent than is often required or desired. For example, in the spray drying of particulate detergents the crutcher mix would have to contain the water initially present with the alpha-olefin sulfonate and therefore might be of a lower solids content than desired, putting a greater drying load on the spray drying equipment utilized. In liquid detergents the active ingredient content might have to be lower than desired because of the presence of the required quantity of water to keep the alpha-olefin sulfonate constituent or the final product in dissolved or satisfactorily suspended form. For the manufacture of bar or cake detergent products the higher proportion of water present with the alpha-olefin sulfonate component might adversely affect the milling of the bar composition, making the milled chip too moist and sticky and resulting in a bar also having such undesirable properties. If utilized in a crutcher mix the more dilute detergent might cause problems to be encountered in forming a desired chip to be dried and there would be an additional evaporation load on the dryer.

The desirability of modifying rheological properties of alpha-olefin sulfonate detergent compositions has been recognized in the past and various methods have been suggested and employed to thin the detergent or otherwise affect such properties. U.S. Pat. No. 3,415,753 discloses the use of a surface active olefin disulfonate to thin an alpha-olefin monosulfonate liquid or paste concentrate. U.S. Pat. No. 3,755,203 teaches the employment of sulfonated vinylidene-olefins to reduce viscosities of alpha-olefin sulfonate crutcher slurries. In the laboratories of applicant's assignee corporation lower aliphatic sulfonates have been utilized as gel-inhibiting agents for alpha-olefin sulfonate compositions and magnesium sulfate has been employed in liquid detergents containing alpha-olefin sulfonates to destroy their gelation potentials. Applicant has found that sodium xylene sulfonate treatment is useful in reducing viscosity and urea is also somewhat effective. Finally, U.S. Pat. No. 3,741,915 teaches the increasing of the viscosities of alpha-olefin sulfonate solutions by the addition of sodium sulfate to them and mentions that sodium chloride was ineffective for this purpose. Although it is apparent that considerable efforts have been made to decrease the viscosities of aqueous alpha-olefin sulfonate compositions and to prevent gelling thereof, there has not been described such a simple, inexpensive method as the present one which utilizes an innocuous, compatible, economical material which so satisfactorily reduces viscosity and prevents gelation without adverse effects upon final detergent products containing the alpha-olefin sulfonate. Furthermore, in another aspect of the present invention the alpha-olefin sulfonate concentration in the aqueous detergent composition may be increased without undue thickening or gelation.

In accordance with the present invention an aqueous alpha-olefin sulfonate detergent composition comprises a viscosity-reducing proportion, at least 10%, of water soluble inorganic halide salt. Such compositions and others of reduced viscosity may be made by admixing with an aqueous alpha-olefin sulfonate detergent composition a viscosity reducing proportion, at least 2%, of the water soluble inorganic halide salt or by admixing with the alpha-olefin sulfonate detergent or with an acid form thereof, during the manufacture of such detergent, such a viscosity reducing proportion of said salt. In preferred embodiments of the invention the alpha-olefin sulfonate detergent composition treated is a water solution, gel or suspension of sodium alpha-olefin sulfonate detergent or the acid form thereof and the halide employed is sodium chloride.

Alpha-olefin sulfonates are normally made by the sulfur trioxide sulfonation of higher alpha-olefins. Such olefins, usually in mixtures, are normally of 12 to 22 carbon atoms, preferably of 12 to 18 carbon atoms. Various "cuts" of olefins may be employed, e.g., 12–14 carbon atoms, and 16–18 carbon atoms, as well as intermediate mixtures. The olefins to be sulfonated may be made by polymerization of ethylene with a Ziegler-type catalyst to produce a mixture of alpha-olefins of various chain lengths, separating therefrom a fraction containing 12 to 18 carbon atoms or principally a higher or intermediate fraction, e.g., $C_{16}$–$C_{18}$ or $C_{14}$–$C_{16}$, or the like, and a fraction of lower molecular weight alpha-olefins, e.g., of 6–8 carbon atoms, which fraction is dimerized and combined with the first mentioned fraction. Other alpha-olefins which may be employed are those obtainable by cracking petroleum wax, substantially pure alpha-olefins made by the polymerization of ethylene (having carbon chain lengths of 12–18, 12, 13, 14, 15, 16, 17 or 18, or mixtures thereof) and olefins obtained by dehydration of higher alcohols of such chain lengths and molecular weight distributions as to be within the desired 12 to 22 carbon atom range or a part thereof.

Exemplary of suitable alpha-olefins that may be utilized are those obtainable from Ethyl Corporation, Industrial Chemicals Division, Baton Rouge, Louisiana and described in their Technical Bulletins dated Oct. 19, 1972, entitled Alpha-Olefins. Such bulletins are subtitled Dodecene-1/Tetradecene-1; Tetradecene-1/Hexadecene-1; and Hexadecene-1/Octadecene-1, and correspond to $C_{12}$–$C_{14}$–, $C_{14}$–$C_{16}$–, and $C_{16}$–$C_{18}$ alpha-olefin blends. Mixtures of two or more of the mentioned blends may also be employed. Such olefins will contain at least 60% of linear terminal unsaturation, no more than 25% of branched terminal unsaturation (a vinylidene group) and a maximum of 20% of internal unsaturation in a linear alkene. Normally these percentages will be 70% minimum, 20% maximum and 12% maximum and ranges will be 75 to 85%, 8 to 20% and 5 to 12%, respectively.

The sulfonation of the olefin may be effected, utilizing as the sulfonating agent sulfur trioxide at a low partial pressure, e.g., below about 100 millimeters of mercury, preferably below about 25 millimeters of mercury. The $SO_3$ is normally in gaseous form, diluted with an inert diluent such as air, nitrogen or other inert gas but sulfonations in vacuums and with the $SO_3$ in liquid form, as in solution in liquid sulfur dioxide at a low temperature, e.g., 0°C., may also be employed although they are not preferred. Generally it is preferred to employ a moving film continuous reactor with about 3–4% of $SO_3$ in air transporting the liquid olefin film, which reacts nearly instantaneously with the $SO_3$. The $SO_3$: olefin molar ratio is usually in the range of about 1.05:1 to 1.2:1, preferably less than about 1.12:1 and an exceptionally good range is from 1.05:1 to 1.1:1.

The reaction product from the sulfonation is then mixed with an excess, usually about 5 to 15% of a molar excess, of aqueous sodium hydroxide solution, normally at a concentration of 25 to 50%, to neutralize the sulfonic acids produced, after which they are heated to effect hydrolysis of the sultones present and cause ring openings thereof. The product, referred to as alpha-olefin sulfonate or alpha-olefin sulfonate detergent, is a mixture of about 29 to 90% of alkenyl sulfonate, about 9 to 70% of hydroxyalkane sulfonate and about 1 to 20% of a mixture of hydroxyalkane disulfonate and alkenyl disulfonate. The alkenyl and hydroxyalkane groups are of 12 to 22 carbon atoms and in the salt form the sulfonate is a water soluble salt selected from the group consisting of alkali metal, alkaline earth metal and ammonium salts in most instances, although other water soluble salts may also be employed, e.g., lower alkylamine and lower alkanolamine salts and magnesium salts. Such "lower" radicals are of 1–4 carbon atoms. Preferred alpha-olefin sulfonates are the sodium salts and these and other such sulfonates preferably include 50 to 70% of sodium alkenyl sulfonate, 20 to 40% sodium hydroxyalkane sulfonate and 5 to 15% of a mixture of disodium hydroxyalkane and alkenyl disulfonates, in which mixture the proportion of disodium hydroxyalkane disulfonate to disodium alkenyl disulfonate is in the range of about 1:5 to 5:1, with the alkenyl and hydroxyalkane groups of the detergent composition compounds containing from 12 to 18 carbon atoms.

Although a wide variety of sulfonation processes may be employed, for example, those described in U.S. Pat. Nos. 3,420,875; 3,428,654; 3,462,525; 3,506,580; 3,579,537; and 3,524,864, a preferred method is like that of the Rubinfeld et al. U.S. Pat. No. 3,428,654, wherein highly diluted sulfur trioxide is employed, usually diluted from 5:1 to 100:1, on a molar basis, preferably 20:1 to 50:1, with an inert gas, such as air, nitrogen, carbon dioxide, sulfur dioxide, low molecular weight paraffinic hydrocarbon or other suitable such gas, with the smaller number of such ratios representing a molar proportion of $SO_3$. During the sulfonation reaction the temperature is maintained below 60°C. and preferably in the 10° to 40°C. range. Sulfuric acid may be added to the sulfonation mixture, in accordance with the teachings of the Rubinfeld et al. patent to reduce the formation of 2-hydroxysulfonic acid and free oil or, in some instances, this step may be omitted.

If utilized, the sulfuric acid treatment takes place under substantially non-hydrolyzing conditions and at a temperature in the 25° to 60°C. range. After acidification, if practiced, the alpha-olefin sulfonic acid mixture may be hydrolyzed, normally by heating to an elevated temperature of 100°C. or higher, e.g., 150° to 200°C., under superatmospheric pressure, after which it is neutralized by contact with a basic material, e.g., aqueous sodium hydroxide or other suitable neutralizing agent, e.g., potassium hydroxide, sodium carbonate, ammonium hydroxide, magnesium carbonate, calcium hydroxide, lower alkylamine or lower alkanolamine. Neutralization is normally effected at a temperature above 60°C., preferably at 65° to 200°C., using superatmospheric pressures, when needed. Most preferably, however, the neutralization is at 90° to 100°C. Normally, the hydrolysis is conducted after neutralization, rather than before.

The product of this reaction is an aqueous alpha-olefin sulfonate detergent normally containing over 20% and most usually over 30% of the alpha-olefin sulfonate detergent, with substantially all the balance thereof, over 75% of the remainder, being water, although there may be present up to 15% of normal impurities, such as sodium sulfate and free oil. Generally, the proportion of sodium sulfate will be from 1 to 10%, preferably from 1 to 5% and that of free oil will be 0.5 to 5%, preferably 0.5 to 2%. Of course, when other detergent salts than the sodium salt are made the sulfate will usually be of the corresponding cation. In preferred embodiments of the invented compositions and in preferred processes for the manufacture of the alpha-olefin sulfonate the content thereof will be from 40 to 60%.

After neutralization and hydrolysis the alpha-olefin sulfonate detergent composition is cooled, usually to about 50° to 70°C., and then it may be bleached to improve its color. The bleaching is usually by hypochlorite, preferably by alkali metal or alkaline earth metal hypochlorite, e.g., sodium hypochlorite, potassium hypochlorite, or calcium hypochlorite, and after completion thereof, which may take from 30 minutes to about 20 hours, preferably from 2 to 10 hrs., excess hypochlorite is destroyed with a suitable sulfite, e.g., sodium sulfite, and the detergent is ready for use. The excess pf hypochlorite employed may be from 1 to 50% or more. Normally from 0.2 to 5% of sodium silicate may also be added with the hypochlorite for its corrosion inhibiting effects. When bleaching is employed a small proportion of chloride may be added to the detergent as a byproduct of the bleaching reaction but this normally does not amount to more than about 3% of the aqueous alpha-olefin sulfonate composition and most of the time is less than this proportion.

The normal aqueous alpha-olefin sulfonate detergent composition produced by the method described will, when cooled to about room temperature or even to higher temperatures, e.g., 40°C., gel or otherwise form difficultly miscible, pumpable and dispersible solids if the alpha-olefin sulfonate detergent concentration is greater than about 30%. This problem may be more severe with such compositions containing higher proportions of alkenyl sulfonate and lower proportions of hydroxyalkane sulfonate and alkenyl and hydroxyalkane disulfonates. The problem is also increased when the alpha-olefin sulfonate detergents are those in which the olefin was of higher carbon contents within the $C_{10}$ to $C_{20}$ range, being greater with $C_{16-18}$ cuts than with $C_{12-14}$, $C_{14-16}$ and $C_{12-16}$. For example, aqueous $C_{14-16}$ olefin sulfonate slurries are now commercially obtainable at 38% active ingredient content while the $C_{16-18}$ homologous mixture is available at a lower AI content, e.g., 33%.

All the $C_{10-20}$ alpha-olefin sulfonates are used commercially, those of lower or middle alkenyls, e.g., $C_{14-16}$, being preferred light duty liquid compositions, especially for foaming ability, the $C_{14-16}$ and $C_{16-18}$ products being about equal in detergency in no-phosphate heavy duty detergent compositions and the $C_{16-18}$ products being superior in phosphate-containing detergents. Therefore, so as to make these materials available for all desired uses the gelling problem should be overcome.

The problem of gelation of the alpha-olefin sulfonate may be alleviated by heating and it is preferred for crutcher mixes of such detergents to be used for detergent manufacture to be at an elevated temperature, e.g., 50° to 95°C. or 60° to 85°C. Yet, the material to be pumped, even if of good rheological properties in such a temperature range, often must be stored below such range and then it becomes difficult to handle. Therefore, in accordance with the present invention, the antigelling inorganic halide salt is preferably admixed with reactant materials or the alpha-olefin sulfonate during the manufacturing procedure, so that the product obtained is of a lower viscosity, is readily pumpable and, by decreasing the moisture content thereof, may be obtained in desired condition, with useful rheological properties, at higher alpha-olefin solids contents.

The aqueous alpha-olefin sulfonate detergent compositions of reduced viscosities are made by mixing with such detergent or with an acid form thereof, during the manufacture of the detergent, a viscosity reducing proportion, at least 2% of the aqueous alpha-olefin sulfonate detergent or detergent acid, of a water soluble inorganic halide. Although bromides and iodides may be employed, it is highly preferred to utilize chlorides, both for economic and performance reasons. To have an appreciable effect, at least 2% of the halide is employed, on a aqueous composition basis. Preferably, about 2 to 20% of the water soluble inorganic halide salt, most preferably the chloride, is utilized and ideally, this proportion is from 10 to 20%. The cation of the inorganic salt may be of any of various metals which form a soluble halide of the type employed or may be an ammonium halide. Preferably, it is an alkali metal, alkaline earth metal or ammonium and most preferably it is a sodium halide. Thus, sodium chloride is most generally employed.

The halide salt is usually not present with the $SO_3$ or olefin during the original sulfonation but it may be added to the acid mix, as soon as it is produced. Alternatively, it may be added with the sulfuric acid, usually concentrated sulfuric acid, employed in accordance with the Rubinfeld et al. patent procedure previously discussed or it may be added to the acidified acid mix. If added at a subsequent step, it may be with the neutralizing agent, usually sodium hydroxide solution of 10 to 50% sodium hydroxide concentration, preferably 40 to 50% thereof, or with any water that is utilized in the neutralization step or with water employed in the hydrolysis reaction. Another mechanism for adding the halide is the hypochlorite or other hypohalite bleaching agent which may be employed. Still another site for addition of the halide is with sodium silicate anti-corrosion additive solution for the detergent compositions being bleached or with sodium sulfite "killer" for the excess chlorine and hypochlorite after the completion of bleaching. Finally, it is possible to add the chloride after production of the detergent composition, although this may not be preferred.

In the various mechanisms for additions of the halide it is preferably employed as a solid or in a concentrated or nearly concentrated solution, e.g., with over 70% of the concentration content of halide being present. In such cases, the moisture contents of the various chemical streams employed will be diminished so that the products made will be of higher detergent contents than would otherwise be possible for the production of pumpable aqueous product. Because the halide reduces the viscosity and the tendency to gel of the alpha-olefin sulfonate it allows for the making of a more concentrated product which is still pumpable and non-gelling. Thus, instead of 30% or lower concentrations of the detergent, from 40 to 60% concentrations and sometimes even more, may be obtained, which are still pumpable, especially at elevated temperatures.

The various additions of halide may be effected entirely at the particular stations previously mentioned or additions may be made at two or more of such stations so as to produce a total halide content in the final product in the desired range. In calculating the contents of halide from the various manufacturing streams and sites in the final product there should be included that which results as a byproduct of hypochlorite bleaching operations but such bleach is not included within the percentage previously described of inorganic halide salt added. Normally it will be preferred to add the halide salt as early in the process as possible because this prevents gelation and pumping problems throughout the process, rather than just in a later part thereof. Nevertheless, it is contemplated as within the invention to make the additions at any and all of the described points. However, a preferred combination of additions is with the neutralization agent, sodium hydroxide, and with the bleaching agent, such as sodium hypochlorite.

The use of the halide has a very desirable effect on the various reactions being undertaken, in addition to its effect on viscosity reduction and gelation prevention. Thus, by adding it to the acid mix from the sulfonator or to the concentrated sulfuric acid employed to treat such acid mix, the viscosity is lowered and better mixing is obtainable, preventing localized "hot spots", which can lead to detergent degradation. This is also the case when the halide is employed with the neutralizing agent or with any water utilized in the neutralization reaction or when it is brought into such reaction with the acid mix (which may or not have been previously treated with the concentrated sulfuric acid). Here, too, there is a benefit due to the reduced viscosity of the product because localized overheating due to the neutralization reaction does not occur as readily in the thinner aqueous detergent compositions. The hydrolysis reaction also proceeds more readily when the viscosity of the product is low, as does the bleaching and even the destruction of excess chlorine and hypochlorite by the sodium sulfite. Any sodium silicate added for anti-corrosion properties is better able to be distributed throughout the detergent composition and therefore can perform its task more effectively. The halide also appears to promote bleaching action, perhaps due to a chemical reaction with the hypochlorite. The various mentioned desirable effects of the additions of halide salts are especially noticeable when the concentration of the alpha-olefin sulfonate detergent is maintained about the same as in previous processes where the halide is not used, and some improvement may be noted even when concentrations are increased to the 40 to 60% range due to the use of lesser quantities of water in the various reagent streams.

Instead of treating the reagent stream or streams, the final product, to which no halide was added, may be treated with halide, again providing that at least 2% of the water soluble inorganic halide salt is admixed with aqueous alpha-olefin sulfonate detergent composition. Detergents employed are the same water soluble salts previously mentioned and the halides are the same, too, with the alpha-olefin sulfonate detergent in the composition being over 30%, preferably being from 40% to 60% of the total composition, with the balance being primarily or entirely water. The water content of such products is generally from 30 to 80%, preferably from 40 to 70%. The amount of halide employed is the same, 2 to 20% and the preferred products treated are of the same compositions. Additionally, from 1 to 5% of sodium sulfate may be present and sometimes this is from 1 to 10%. Such contents are also often present in the process streams being treated, as these were previously described. Although the detergent composition being treated may be of about 20 to 30 or 35% alpha-olefin sulfonate detergent content it is preferred that it be over 30% and usually is in the 30 to 35% range. This concentration is increased to over 40% by a process which includes admixing with the aqueous detergent from 2 to 20%, preferably from 10 to 20% of inorganic halide salt, preferably sodium chloride, to form two phases, and removing one of these from the other to produce the alpha-olefin sulfonate detergent composition of increased active ingredient content, over 40%. Normally the bottom layer of such phases, or the heavier layer, if they are centrifuged or otherwise force separated, will be higher in inorganic salt and the upper layer will be higher in detergent content. Thus, by the separation, some of the excess salt is removed and so is the unwanted additional water.

In another aspect of the invention various described detergent compositions made, having from 30 to 60% of alpha-olefin sulfonate detergent content, will very preferably have 10% or more, preferably 10 to 20% of the inorganic halide present to diminish viscosity. The product may not be a perfect solution but will be more readily pumpable and less apt to gel than comparable products without the halide present. It is found that even less likely to gel or thicken objectionably will be those compositions containing a substantial proportion, over 75% of the "olefin content", as represented by the product, of 14 to 16 carbon atoms. An improvement is also noted with those compositions maintained at an elevated temperature in the range of 50° to 95°C., preferably 60° to 85°C.

It has been noted that the presence of inorganic sulfate, such as alkali metal sulfate, increases the viscosity of aqueous alpha-olefin sulfonate detergent compositions. This sometimes results in the production of an aqueous detergent which is so thick, contains so much dissolved material or includes so much gel that it is not pumpable and sometimes not even readily miscible with other usual detergent product components. When more than 10% of the sulfate is present the problem of thinning the composition may be insuperable. With quantities up to 10%, treatment with halide according to the present invention may be helpful and in quantities less than 5%, e.g., from 1 to 5% of sodium sulfate or other water soluble alkali metal sulfate, alkaline earth metal sulfate or other sulfate, the use of the described quantities of halide salt, preferably sodium chloride, will usually notably thin the detergent composition. Of course, when the gelation or thickening problem is greatest, as with $C_{16-20}$ alpha-olefin sulfonates, at higher concentrations and with greater quantities of sodium sulfate, more halide, within the ranges described, is employed to "thin" the mixture. Such thinning may produce a perfectly clear solution, may dissolve or disperse the gel or may form suspendable particles or crystallites which, unlike gelling materials, do not produce interconnecting, waterentrapping bonds and so do not from a solid mass or so viscous a mix as to impede ready agitation, pumping and atomization. After halide treatment such particles, if not emulsifiable, are usually suspendable with moderate agitation.

The aqueous alpha-olefin sulfonate detergent composition comprising a viscosity reducing proportion, preferably at least 10%, of water inorganic halide salt, and at least 2% when the halide is added in a thinning process addition step, is useful in making detergent compositions in liquid, particulate or bar form. In all such cases an aqueous crutcher mix or other mixture thereof is normally prepared with other constituents of the desired end product. In the case of particulate detergent compositions, whether heavy duty or light duty, such a crutcher mix may be roll dried, film dried, tray dried, spray dried and in some cases, spray cooled to produce solid products. When such a dried or otherwise solidified product is too large it may be size reduced to the desired particle size distribution range, using normal size reduction equipment. In making a bar detergent product the crutcher mix may be dried or otherwise solidified and subsequently converted to bar form, usually with intermediate milling and preferably with plodding and pressing to bar form, although it is also contemplated that such compositions may be formed by molding techniques. Liquid detergents may be mixed in the crutcher or other mixer with the balance of ingredients intended for incorporation therein. The order of mixing in the crutcher does not appear to be of vital importance but it is normally desired that the alpha-olefin sulfonate detergent be added to the crutcher in thinned state and often this is done before the addition of other components. In some cases, although less desirable, the gelled alpha-olefin sulfonate detergent composition may be thinned in the crutcher by addition of the halide and subsequently other components of the desired detergent composition may be mixed therewith. It is usually not desirable for the thinning of the alpha-olefin sulfonate to take place in the presence of other components of the detergent mixture, although this is possible.

The advantages of the thinner alpha-olefin sulfonate detergent have been mentioned previously and will not be repeated again in detail here. However, such advantages will be illustrated by mention of the process for making spray dried particulate heavy duty synthetic compositions based on the alpha-olefin sulfonate detergent. Normally, it will be desirable to have the solids content of the crutcher mix as high as feasible to minimize the load on the spray dryer. The solids content of the aqueous crutcher mix will normally be over 25% and preferably will be in the 30 to 80% range, most preferably about 60 to 75% solids, when possible. Of course, the crutcher mix will also usually include other constituents than the alpha-olefin sulfonate and water. The most important of these in making a heavy duty detergent is the builder salt or a mixture of such salts. Examples of suitable water-soluble inorganic alkaline builder salts, all of which are well known in the art, include alkali metal carbonates, borates, phosphates, polyphosphates, bicarbonates and silicates, of which specific examples are sodium and potassium tetraborates, bicarbonates, carbonates, silicates, tripolyphosphates, pyrophosphates, orthophosphates and hexametaphosphates. Sodium sulfate and sodium chloride are not normally characterized as builder salts, usually being considered to be inactive in promoting detergency and therefore, may be called fillers, instead. In addition to the many well known inorganic builder salts, various organic salts which build detergency in alkaline media may also be utilized, such as the ethylene diamine tetraacetates, nitrilotriacetates and N-(2-hydroxyethyl)-nitrilodiacetates. Other acceptable builder salts include the sodium and potassium phytates, polyphosphonates, polycarboxylate polymers and copolymers and hydroxy or polyhydroxy carboxylic acid salts, such as gluconates and citrates. Of course, mixtures of the various inorganic, organic and mixed inorganic and organic builder salts may be employed. Normally, the proportion of builder salt, with respect to the alpha-olefin sulfonate detergent, will be from 1:2 to 10:1, preferably from 1:1 to 5:1. Preferred builder salts include disodium hydroxyethyl iminodiacetate, sodium gluconate, sodium citrate, sodium carbonate and sodium silicate, preferably of an $Na_2O:SiO_2$ ratio in the range of 1:1.6 to 1:3, most preferably about 1:2 to 1:2.8. Trisodium nitrilotriacetate is also a good builder, where it is not considered objectionable for biological reasons, and of course, pentasodium tripolyphosphate is an ideal builder when inland stream eutrophication problems are not an issue.

The built detergent composition may contain other detergents, too, including synthetic organic detergents of the anionic, noionic and/or Zwitterionic types, preferably avoiding cationic detergents. Listings of such detergents are found in McCutcheon's *Detergents and Emulsifiers*, 1973 Annual, North American Edition, and will not be unnecessarily repeated here. Suffice it to say that they are usually of the sulfated or sulfonated lipophile types, in the forms of their water soluble salts, preferably alkali metal, ammonium, alkanolamine or alkyl amine salts. Of course, adjuvants such as bactericides, foam stabilizers, anti-foams, anti-redeposition agents, perfumes, colorants, fluorescent brighteners, solvents, and others known in the detergent art may also be used.

After mixing the builder and alpha-olefin sulfonate, thinned with halide salt, the mixture is pumped from the crutcher to the spray dryer through small spray orifices into a drying gas. The orifices or spray nozzles utilized will be such as to produce spray droplets in the 6 to 140 or 200 mesh or equivalent range. The small spray orifices utilized have openings of about 0.01 to about 1 mm., preferably 0.05 to 1 mm., resulting in spray dried particles in the mentioned 6 to 140 or 200 mesh size range, U.S. Standard Sieve Series. The moisture content of the particles, after drying, will normally be from 2 to 15% and they will be in substantially globular, expanded form. Because of the treatment of the alpha-olefin sulfonate with halide salt the crutcher mix will readily pass through the fine screens, the high pressure Triplex pumps normally utilized, which generate pressures of about 200 to 2,000 lbs./sq. in. and the small spray nozzles or orifices, into the drying air, which is usually at a temperature of about 100° to 400°C. The product will then fall downwardly, preferably countercurrently, through a moving current of the drying air and will be collected at the bottom of the spray tower, after which perfume and other heat sensitive adjuvants may be sprayed onto it or admixed with it.

In the FIGURE there is illustrated a schematic representation of a process in which alpha-olefin is sulfonated, converted to detergent, treated, crutched and spray dried to produce built detergent composition particles.

In the elevational view presented sulfur trioxide enters the system through line 11, is blended with air entering through line 13 and passes via line 15 into a falling film reactor 17, with alpha-olefin entering the reactor through line 19. From the reactor, wherein it is almost instantaneously formed, the acid mix produced leaves via line 21 while exhaust gas is taken off through line 23 and passes to scrubbers, not shown, wherein unused sulfur trioxide and various condensable or soluble byproduct gases are removed to avoid air pollution. In the view illustrated the acid mix is treated with sulfuric acid, usually in concentrated form, entering treating vessel 25 through line 27. Subsequently the product leaves vessel 25 through line 29 and enters neutralizing vessel 31. A suitable neutralizing agent, such as aqueous sodium hydroxide, enters vessel 31 through line 33 and any water that may be needed to dissipate the heat of neutralization and dissolve the product enters vessel 31 through line 35. Although it is not illustrated, in the passage between vessels 25 and 31 some hydrolysis may be effected but this is not necessary. The neutralized alpha-olefin sulfonate, preferably as sodium alpha-olefin sulfonate, leaves vessel 31 through line 37 and enters a hydrolyzing tower 39 wherein it is subjected to hot hydrolysis, at an elevated temperature within the range previously given. The hydrolysis product leaves tower 39 through line 41 and passes into a cooler 43, wherein it is cooled down to a suitable temperature for subsequent bleaching, which is effected in tower 45, into which the cooled alpha-olefin sulfonate passes through line 47. Hypochlorite bleach enters the tower through line 49. The bleached product leaves through line 51 and enters a holding tank 53 from which it exits several hours later through line 55 and passes into vessel 57, into which a hypochlorite-destroying chemical, such as sodium sulfite, is added through line 59. The finished alpha-olefin sulfonate detergent product, preferably at a concentration over 40% in the aqueous medium, is removed via line 61 and is passed to a crutcher 63 from which it exits via line 65 and passes through pump 67, line 69, and spray nozzle 71 into spray drying tower 73, from which a dried, particulate built synthetic organic detergent product is taken off at the bottom. Line 75 into the crutcher represents a line through which builder salt may be added. Also, lines 77, 79, 81, 83, 85 and 87 represent lines through which the thinning quantity of halide may be added to the acid mix-$H_2SO_4$ reactor; the neutralizer; the bleach tower; the bleach slurry tank; the "killer" vessel; and the crutcher, respectively. Of course, additions need not be through separate lines and the product may be added with other reagents through already existing lines. Furthermore, additions may be in any of the connecting pipes, lines or passageways in the system at appropriate points.

The following examples illustrate the invention but do not limit it. Unless otherwise indicated, all parts are by weight and all temperatures are in °C.

EXAMPLE 1

Utilizing the apparatus illustrated in the FIGURE a $C_{16}$–$C_{18}$ alpha-olefin blend, obtained from Ethyl Corporation and identified as their Hexadecene-1/Octadecene-1, which includes such compounds with some eicosene-1, produced by Ziegler ethylene chain growth, is sulfonated in a falling film reactor. The olefin mixture is a clear, water-white, mobile liquid, which is over 99% olefinic. It comprises no more than 2% of $C_{14}$, 50% ±5% of $C_{16}$, no more than 10% of $C_{20}$ and the balance of $C_{18}$ olefins. Of these the percentages of linear terminally unsaturated, branched terminally unsaturated and linear internally unsaturated monoolefins are a minimum of 60, a maximum of 25 and a maximum of 17%, respectively. The sulfur trioxide utilized is at a concentration of about 3 to 4% by volume in dry air and a high velocity stream of this mixture transports the liquid olefin film continuously through the reactor and facilitates reaction of the sulfur trioxide essentially instantaneously with the olefin. The ratio of $SO_3$:olefin is maintained at about 1.1 and will be kept within the 1.05–1.20 range. Lower ratios than these result in high amounts of unreacted olefin in the product and higher ratios may produce degradations, resulting in an objectionably colored product. The reaction temperature is held at about 30°C., with cooling.

The acid mix produced is then treated with concentrated sulfuric acid, in the manner of U.S. Pat. No. 3,428,654, to diminish the percentage of any free oil that might be present. The sulfuric acid treatment is conducted at a temperature of 30°C. The concentrated sulfuric acid utilized is about a 95% solution and the proportion utilized is about 25 parts by weight per hundred parts of the acid mix. Of course, depending on the particular olefin mix being sulfonated, the proportions of reactants, acid mix and other treating chemicals and the temperatures utilized will be selected so as to maintain the fluidities of the process streams.

After acidification, the detergent acid and the excess sulfuric acid (or oleum, e.g., 20% oleum), are neutralized with sodium hydroxide, in 50% aqueous solution, at a temperature of about 92°C., with the proportion of alkali added being such as to produce a pH of about 10.5. In the neutralizing sodium hydroxide solution there is included 6%, on a final aqueous alpha-olefin sulfonate detergent composition basis, of sodium chloride, dissolved in the aqueous medium. The neutralized product is noticeably thinner than similar products in which no sodium chloride is employed.

The neutralized slurry is then hydrolyzed at a temperature of about 165°C. and a pressure of 120 lbs./sq. in. for about three minutes, after which it is cooled to a temperature of about 60°C. and is bleached with sodium hypochlorite, aqueous solution, in a bleach tower, followed by holding in a bleach tank so that the entire bleaching period is about five hours. The concentration of sodium hypochlorite utilized is about 5% and that of the sodium silicate ($Na_2O$:$SiO_2$ = about 1:2.4) is about 4%. With the hypochlorite there is added an additional 6%, on a final aqueous alpha-olefin sulfonate detergent composition basis, of sodium chloride, making about 12% thereof in the final product, plus about 1% obtained as byproduct of the bleaching operation. Moisture contents of the neutralizing caustic, hydrolysis water, bleach solution and sulfite solution are kept as low as possible while maintaining fluidity of the processing stream. The bleaching operation is effected at about room temperature, e.g., 25°C., although higher temperatures, e.g., 30–50° C. are also employed. The hypochlorite utilized is in an excess of about 10% and this excess is converted to chloride and sulfate by means of the stoichiometric quantity of sodium sulfite added in the "killing" vessel.

The product resulting has an alpha-olefin sulfonate content of about 45% and includes about 3% of sodium sulfate and 13% of sodium chloride, with the balance being water. The sodium alpha-olefin sulfonate thereof contains 60% of sodium alkenyl sulfonate, 30% of sodium hydroxyalkane sulfonate and 10% of a mixture of disodium hydroxyalkane disulfonate and disodium alkenyl disulfonate in about equal proportions, with the higher hydroxyalkane and higher alkenyl groups thereof being of about 16 to 18 carbon atoms and of chain length distributions like that of the originally charged alpha-olefin. In a variation of this experiment the active ingredient content (alpha-olefin sulfonate) is increased to 55%, with 10% NaCl and 35% water being present, too.

The product made is then mixed with other constituents of the spray dried detergent composition in a conventional detergent crutcher. Initially, it is raised to a temperature of 60°C. and then there are blended with it particulate, free flowing, solid burner salts plus some solutions thereof, and the usual adjuvants. Thus, the crutcher mix is at a solids content of about 60%, containing, on an anhydrous basis, about 18% of sodium alpha-olefin sulfonate detergent, 8% of sodium silicate, ($Na_2O$:$SiO_2$ = 1.2.0), 40% of pentasodium tripolyphosphate, 24% of sodium carbonate, 1.5% of sodium sulfate, 6.5% of sodium chloride and 2% of adjuvants, including 1% of sodium carboxymethyl cellulose, with the balance being bactericides, foam stabilizers and colorants.

The crutcher mix is readily miscible and is pumped, strained or filtered, and atomized into a heating drying tower having 300°C. drying air passing through it. The screens or filters used protect the spray nozzles from blocking with particles greater than their orifice openings, which are of about 0.5 mm. diameter. The product made has a moisture content of about 5% and is of substantially spherical particles in the 6 to 140 mesh range. During spray drying the orifices are not blocked and normal pumping pressures of 700 lbs./sq. in. are employed. The crutcher mix being processed is noticeably thinner than a similar mix in which sodium chloride is not present. The spray dried product resulting is an effective readily biodegradable detergent for heavy duty household and industrial laundry uses.

When modifications are made in the experiment, in accordance with the previous description, following the procedures of this invention, similar results are obtained. Thus, when the Hexadecene-1/Octadecene alpha-olefin blend described in this example is replaced by Ethyl corporation's Tetradecene-1/Hexadecene-1, containing the following percentages of alpha-olefin fractions, good processing and excellent products are obtainable. Such olefins contain no more than 2% of $C_{12}$ and no more than 5% of $C_{18}$ olefins and at least 50% of $C_{14}$ and at least 30% of $C_{16}$ olefins. These olefin isomers are at least 70% of linear terminally unsaturated configuration, no more than 20% are branched and terminally unsaturated and no more than 12% are linear and internally unsaturated. The only difference in the procedure followed is that the solids content of the product, as it is sent to the crutcher, is somewhat lower, about 42%, and sometimes more NaCl is used, e.g., about 15–20%, because the alpha-olefin sulfonate produced is not quite as readily dispersible or convertible to a very fluid dispersion-solution as that having higher carbon atom contents in the olefin moieties.

In a similar fashion, the starting alpha-olefins are replaceable by the Ethyl Corporation product identified as Dodecene-1/Tetradecene-1, containing no more than 2% each of $C_{10}$ and $C_{16}$ alpha-olefins and at least 60% and 30%, respectively, of $C_{12}$ and $C_{14}$ alpha-olefins, in which product the olefin isomer distribution is such that at least 85% of the olefins are linear and terminally unsaturated, no more than 10% are branched and terminally unsaturated and no more than 5% are linear and internally unsaturated. In such case, the concentration of the final aqueous alpha-olefin detergent dispersion-solution is about 35%.

An equal mixture of all three of the previously described alpha-olefins is also processable by the same method to a final solution-dispersion concentration in the crutcher (without other material) of about 41%.

The final crutcher mix is varied in all such cases, to include 10% of sodium paraffin sulfonate, with the sodium carbonate content being correspondingly reduced. In another variation, 5% of nonyl phenoxyl polyethoxyl ethanol, containing about 15 ethoxy groups per molecule, is also used in replacement of additional $Na_2CO_3$, in some cases with the entire content of the paraffin sulfonate and nonionic detergent being added in the crutcher and in other instances with 2% of the nonionic being present in the crutcher and the additional 3% being post-sprayed onto the product. In all instances, the heavy duty synthetic detergent resulting is satisfactory for intended applications thereof.

Liquid detergent compositions are made by thinning the crutcher mix with about an equal proportion of aqueous alcoholic medium, comprising equal parts of ethanol and water, and include from about 1 to 10% of a hydrotrope, such as sodium cumene sulfonate, sodium toluene sulfonate, sodium benzene sulfonate or a mixture thereof. Light duty detergent products are produced by removing the builder salts from the crutcher mix and replacing them with lesser proportions of sodium chloride or other filler salt which does not promote gelation and which will harden the product enough in the spray dryer to make a useful pourable particulate composition. Such a particulate product may have sodium sulfate post-added to it as an extender. In a similar manner the crutcher mix without builder salts is mixed, deposited on a chill roll, removed as ribbons, dried, milled and plodded to bar form. Optionally, the contents of the builder salts may be replaced by soaps, e.g., 85:15 sodium tallow:coco soap, to adapt the built product for detergent-soap bar use.

Additional changes in the procedures effected include replacements of the sodium chloride with magnesium chloride, potassium chloride, ammonium chloride, sodium bromide, sodium iodide and in some cases, calcium chloride. Such halides also exert the described thinning effects.

The proportions of sulfate and halide in the mentioned processes are changed so as to utilize 2%, 5%, 8% and 18% of added halide, e.g., sodium chloride, in the presence of 1%, 3%, 5% and 8% of sulfate, e.g., sodium sulfate. Also, the sulfates are modified to be magnesium sulfate, potassium sulfate and ammonium sulfate (ammonium salts are not usually employed except where the final product is desired to have an ammonia odor or where such is not objectionable). In all the instances mentioned, a satisfactory solution or solution-dispersion results, which is satisfactorily crutched and spray dried without creating solid or gelatinous masses in the crutcher, being poorly pumpable and blocking strainers and spray drying nozzle orifices.

EXAMPLE 2

Following the methods of Example 1, utilizing the materials and proportions described therein, alpha-olefin sulfonate detergent composition is made without initial further acidification of the acid mix with concentrated sulfuric acid. Thus, the sulfate content of the final product is diminished and higher concentrations of the alpha-olefin sulfonate are obtainable in the final solution-dispersion sent to the crutcher or other mixer. Normally, such concentration will be about 2 to 5% higher because of the diminution of the gelling effects due to the presence of the additional amount of sodium sulfate in the processes of Example 1.

Other modifications made in the procedure of Example 1 include nuetralization of the acid mix to pH's in the range of about 7 to 11.5, e.g., 7.5, 9 and 11. The hypochlorite bleaching is effected with calcium hypochlorite and in some cases bleaching with an equivalent proportion of chlorine is carried out. The sodium sulfite, used to destroy any excess hypochlorite or chlorine, is replaced by potassium sulfite, magnesium sulfite or other suitable reducing agent. By using reducing agents that do not contribute sulfate to the final product, e.g., phosphites, ferrous chloride, stannous chloride, etc., and by avoiding sulfuric acid treatment of the acid mix, products essentially free of sulfate are made, which result in freer flowing detergent solution-dispersions at higher alpha-olefin sulfonate contents, e.g., 50%, in the aqueous detergent composition.

EXAMPLE 3

The procedures of Examples 1 and 2 are repeated, utilizing other compounds to treat the alpha-olefin sulfonate detergent compositions instead of the various halide salts employed. These include sodium carbonate, borax, sucrose, sodium acetate, magnesium sulfate, potassium sulfate, sodium sulfate, sodium silicate, urea and sodium xylene sulfonate. Proportions employed are the same as those described for the sodium chloride treatments. It is found that the potassium and magnesium sulfates cause considerably less gelling action than the sodium sulfate but that sodium silicate, when present in a quantity of about 10%, may promote gelling. Urea reduces the viscosity of the solutions and sodium xylene sulfonate has a very desirable effect in reducing such viscosities. The other compounds appear to have little or no effects on the gelation tendencies and viscosities of the alpha-olefin sulfonate compositions. Accordingly, in some aspects of the invention the sodium chloride utilized is supplemented with about ⅓ additional part of sodium xylene sulfonate per part of sodium chloride. Improved flowability of the product results and the sodium xylene sulfonate is a useful additive for the manufacture of liquid detergent compositions from alpha-olefin sulfonates.

Further improvements in the flowability of the alpha-olefin sulfonate compositions are obtainable by diminishing the sodium silicate content of the crutcher mix to 0 or ½ the content normally present and/or described in the other examples, and postadding such silicate to the spray dried particular detergent product.

EXAMPLE 4

The procedures of Examples 1–3 are modified to include the additions of anti-gelling halide in various other steps in the process than the neutralizing and bleaching stages. Thus, when 25% of the halide, e.g., sodium chloride, is added to the acid mix, the neutralizing vessel, the bleach tower and the killer vessel, an effective thinned final product is obtained. Similarly, when half of the halide is added with the acid mix and half with the neutralizing agent a very desirable early thinning is the result. Good rheological properties throughout the process are obtained when ⅓ of the halide is added with water fed to the neutralizing vessel, ⅓ is added with the bleach and ⅓ is further added in the bleach retention vessel. In a similar fashion, the halide is added to the crutcher, before admixing of other constituents with the alpha-olefin sulfonate detergent, and the crutcher mix is thinned. In some cases, the thinned mix is allowed to separate into two phases and the heavier phase, that containing more halide and less detergent, is withdrawn, resulting in a higher concentration, e.g., 50%, of the olefin sulfonate in the aqueous medium in the crutcher. In other instances, only thinning is effected in the crutcher and phase separation is not awaited nor is any separated phase removed. Nevertheless, in such an instance the crutching is facilitated by the thinning of the alpha-olefin sulfonate.

EXAMPLE 5

The procedure of Example 1 is followed, utilizing alpha-olefins of other manufacturers, including those obtainable from Stepan Chemical Corp., Pacific Soap Company, Witco and Pilot California. Such olefins, sulfonated by such companies, utilize Stepan, Chemithon, Chemithon plus Allied and $SO_3/SO_2$ liquid design sulfonation methods. The sulfonation methods may also be those of U.S. Pat. Nos. 3,420,875; 3,462,525; 3,506,580; 3,524,864; and 3,579,537. The olefins vary, being obtainable from Ethyl Corp., Chevron Chemical Company, Gulf, Shell and Jefferson Chemical Company, and being made by various methods, including modified Ziegler, cracked wax, Ziegler, Ziegler and dimer techniques. Nevertheless, despite the diversities of methods employed and the different olefin starting materials, the use of the halide addition produces thinner aqueous alpha-olefin sulfonate detergent compositions, as previously described.

EXAMPLE 6

The procedure of Example 1 is followed utilizing the $C_{16-18}$ alpha-olefin (Ethyl Corp.) and not adding any halide during the manufacturing process. The product obtained is found to be a gel when at room temperature (20°C.) when olefin sulfonate content in the product is 30%. The addition of 2% of sodium chloride to such product does not improve it sufficiently to make it readily pourable. However, the addition of 2% sodium chloride to a similar product at a 40% alpha-olefin sulfonate content does noticeably diminish the thickness of the gel and helps to make the product pourable. Employing 4% sodium chloride, admixed with the detergent in the crutcher, makes the product pourable and results in some phase separation. Additions of 5.8% and 10.8% of sodium chloride further increase fluidity and produce low viscosity solution-dispersions. When the phases are separated, the alpha-olefin sulfonate contents of the products are increased by 5–10%, to 35–50%. The above experiments are run with 0.6% of sodium sulfate in the product. More improved fluidities are obtained when the percent of sulfate is 0%, 0.1% and 0.3%. Additionally, when $C_{14-16}$ and $C_{12}$-$C_{14}$ olefin sulfonate cuts are employed, with concentrations of sodium sulfate of about 1%, essentially the same results are obtainable although the concentrations of the aqueous olefin sulfonates resulting may be higher.

From a variety of experiments like those reported, it is learned that it will often be desirable to employ from 3 to 25% of the sodium chloride, preferably 5 to 20%, or about 15%, and to maintain the sodium sulfate content below 3%, preferably below 2% and most preferably, as low as possible. Also, from experiments on different cuts of olefin sulfonate it is learned that greater quantities of sodium chloride are employed to make freeflowing the lower alpha-olefin sulfonates, those of $C_{12}$–$C_{14}$ and $C_{14}$–$C_{16}$ olefin groups. When 2% of sodium sulfate is present, as much as 20% of sodium chloride may desirably be utilized to satisfactorily thin such aqueous composition.

From the experiments run it does not appear to matter whether the sodium chloride is introduced into the olefin sulfonate process or the final product before or after the sodium sulfate but normally it will follow the addition of some sodium sulfate, although theoretically it should go first.

When, in these experiments, sodium chloride is replaced with potassium chloride, lithium chloride, ammonium chloride, calcium chloride, magnesium chloride or other suitable halides viscosity reductions of the types mentioned are obtained. Such thinnings are improved at elevated temperatures, in the 50° to 95°C. range, e.g., 60°–80°C.

The proceding examples illustrate various aspects of the present invention relating to the dimension of viscosity or thinning of alpha-olefin sulfonate detergent compositions and the prevention of gel formation or the destruction of gels therein but it is clear that they also relate to treatments of alpha-olefin sulfonates intended for other than detergent uses. The processes described may be continuous or batch and may be effected with different types of manufacturing equipment than those specifically disclosed herein.

The invention has been described with respect to descriptions and illustrations of specific embodiments thereof but is not to be limited to these since it is evident that one of skill in the art will be able to utilize substitutes and equivalents without departing from the sprit of the invention or going beyond its scope.

What is claimed is:

1. An aqueous alpha-olefin sulfonate detergent composition consisting essentially of such alpha-olefin sulfonate detergent, aqueous medium and a viscosity reducing proportion, at least 10%, of a water soluble inorganic halide salt selected from the group consisting of alkali metal, alkaline earth metal and ammonium halides and mixtures thereof.

2. A detergent composition according to claim 1 wherein the alpha-olefin sulfonate detergent is a water soluble salt selected from the group consisting of alkali metal, alkaline earth metal and ammomium salts and there is present in the detergent composition over 30% of said alpha-olefin sulfonate detergent and about 10 to 20% of such halide or mixture of such halides.

3. A detergent composition according to claim 2 wherein there is present from 30 to 60% of the alpha-olefin sulfonate detergent and the halide is sodium chloride.

4. A detergent composition according to claim 3 which is an aqueous solution-dispersion of the alpha-olefin sulfonate detergent and the chloride in which the alpha-olefin sulfonate detergent is a mixture of about 29 to 90% of alkenyl sulfonate, about 9 to 70% of hydroxyalkane sulfonate and about 1 to 20% of a mixture of hydroxyalkane disulfonate and alkenyl disulfonate, in which the alkenyl and hydroxyalkane groups are of 12 to 22 carbon atoms.

5. A composition according to claim 4 wherein the alpha-olefin sulfonate detergent is sodium alpha-olefin sulfonate, the content thereof is from 40 to 60% and such detergent is a mixture of about 50 to 70% of sodium alkenyl sulfonate, 20 to 40% of sodium hydroxyalkane sulfonate and 5 to 15% of a mixture of disodium hydroxyalkane and alkenyl disulfonates, in which mixture the proportion of disodium hydroxyalkane disulfonate to disodium alkenyl disulfonate is in the range of about 1:5 to 5:1, with the alkenyl and hydroxyalkane groups of the detergent composition compounds containing from 12 to 18 carbon atoms.

6. A detergent composition according to claim 5 wherein there is also present from 1 to 10% of an alkali metal sulfate.

7. A detergent composition according to claim 6 wherein the alkali metal sulfate is sodium sulfate and the proportion thereof is from 1 to 5% of the aqueous detergent composition, the aqueous medium is water and the composition is at an elevated temperature in the range of 50 to 95°C.

8. A detergent composition according to claim 7 wherein the alkenyl and alkane groups of the alkenyl sulfonate, hydroxyalkane sulfonate, hydroxyalkane disulfonate and alkenyl disulfonate are substantially, over 75% thereof, of 16 to 18 carbon atoms.

9. A method of reducing the viscosity of an aqueous alpha-olefin sulfonate detergent composition, which consists essentially of an alpha-olefin sulfonate detergent and an aqueous medium, which comprises admixing with it a viscosity reducing proportion, at least 2%, of a water soluble inorganic halide salt selected from the group consisting of alkali metal, alkaline earth metal and ammonium halides and mixtures thereof.

10. A method according to claim 9 wherein the alpha-olefin sulfonate detergent is a water soluble salt selected from the group consisting of alkali metal, alkaline earth metal and ammonium salts, there is present in the detergent composition over 30% of said alpha-olefin sulfonate detergent and there is admixed with such aqueous detergent composition about 2 to 20% of such halide or mixture of such halides.

11. A method according to claim 10 wherein the alpha-olefin sulfonate detergent is sodium alpha-olefin sufonate detergent, the halide is sodium chloride, the alpha-olefin sulfonate detergent is a mixture of about 29 to 90% of sodium alkenyl sulfonate, about 9 to 70% of sodium hydroxyalkane sulfonate and about 1 to 20% of a mixture of disodium hydroxyalkane disulfonate and disodium alkenyl disulfonate in which the alkenyl and hydroxyalkane groups are of 12 to 22 carbon atoms and there is also present from 1 to 10% of sodium sulfate.

12. A method according to claim 11 wherein the aqueous sodium alpha-olefin sulfonate detergent composition treated contains from 1 to 5% of sodium sulfate and the aqueous medium thereof is water, and after admixing the sodium chloride with the detergent composition two phases are formed and one of them is removed from the other to produce an aqueous alpha-olefin sulfonate detergent composition of increased alpha-olefin sulfonate detergent content, over 40%.

13. A method according to claim 11 wherein there is admixed with the sodium chloride-containing aqueous alpha-olefin sulfonate detergent composition, in a proportion from 1:2 to 10:1 with respect to the alpha-olefin sulfonate detergent, a builder salt selected from the group consisting of alkali metal carbonates, borates, phosphates, polyphosphates, bicarbonates and silicates, ethylene diamine tetraacetates, nitrilotriacetates, N-(2-hydroxy-ethyl) - nitrilodiacetates, phytates, polyphosphonates, poly-carboxylate polymers and copolymers and hydroxy and polyhydroxy carboxylic acid salts, and mixtures thereof, and the mixture is spray dried by atomization through small spray orifices into a heated drying gas to produce a particulate detergent product.

14. A method of producing an aqueous alpha-olefin sulfonate detergent composition of reduced viscosity which comprises admixing with the alpha-olefin sulfonate detergent or with an acid form thereof, during the manufacture of such detergent, a viscosity reducing proportion, at least 2% of the aqueous alpha-olefin sulfonate detergent or detergent acid, of a water soluble inorganic halide.

15. A method according to claim 14 wherein the aqueous alpha-olefin sulfonate detergent or acid form thereof is that obtained by sulfonation of an alpha-olefin of about 12 to 22 carbon atoms with sulfur trioxide and, in the case of the alpha-olefin sulfonate detergent, neutralizing, and hydrolyzing any sultone formed to the corresponding hydroxyalkane derivative.

16. A method according to claim 15 wherein the aqueous alpha-olefin sulfonate detergent composition of reduced viscosity is of a water soluble salt selected from the group consisting of alkali metal, alkaline earth metal and ammonium salts, the halide is selected from the group consisting of alkali metal, alkaline earth metal and ammonium halides are there is present in the composition over 30% of said alpha-olefin sulfonate detergent and 2 to 20% of the water soluble inorganic halide salt.

17. A method according to claim 16 wherein the detergent composition is an aqueous solution-dispersion containing 30 to 60% of sodium alpha-olefin sulfonate detergent and sodium chloride, and in which the sodium alpha-olefin sulfonate detergent is a mixture of about 29 to 90% of sodium alkenyl sulfonate, about 9 to 70% of sodium hydroxyalkane sulfonate and about 1 to 20% of a mixture of disodium hydroxyalkane disulfonate and disodium alkenyl disulfonate, in which the detergent mixture the alkenyl and hydroxyalkane groups are of 12 to 18 carbon atoms.

18. A method according to claim 17 wherein the halide salt is sodium chloride and it is mixed with the alpha-olefin sulfonic detergent acid prior to neutralization thereof or during neutralization thereof or is mixed with the alpha-olefin sulfonate detergent after such neutralization.

19. A method according to claim 18 wherein the sodium chloride is mixed with aqueous sodium hydroxide solution, which is then employed to neutralize the alpha-olefin sulfonic detergent acid.

20. A method according to claim 18 wherein sodium chloride is mixed with sodium hypochlorite and the alpha-olefin sulfonate detergent is bleached with the mixture, the proportion of sodium chloride being sufficient so that together with such chloride resulting from the sodium hypochlorite bleaching, the content thereof is from 2 to 20% of the aqueous alpha-olefin sulfonate detergent composition resulting.

21. A method according to claim 18 wherein sodium chloride is admixed with the alpha-olefin sulfonic detergent acid and alpha-olefin sulfonate and the total proportion thereof is 10 to 20% of the aqueous alpha-olefin sulfonate detergent composition produced.

22. A method according to claim 21 wherein the aqueous alpha-olefin sulfonate detergent composition contains from 40 to 60% of sodium alpha-olefin sulfonate detergent, which is a mixture of 50 to 70% of sodium alkenyl sulfonate, 20 to 40% of sodium hydroxyalkane sulfonate and 5 to 15% of a mixture of disodium hydroxyalkane disulfonate and disodium alkenyl disulfonate in which the proportion of disodium hydroxyalkane disulfonate and disodium alkenyl disulfonate is in the range of 1:5 to 5:1, and there is also present from 1 to 10% of sodium sulfate.

23. A method according to claim 22 wherein the sodium chloride is in mixture with sodium hydroxide neutralizing agent when it is employed to neutralize the alpha-olefin sulfonic detergent acid and such neutralization is at a reduced viscosity due to the presence of the sodium chloride, and wherein the sodium chloride is also admixed with the neutralized alpha-olefin sulfonate during hypochlorite bleaching thereof so as to further reduce the viscosity of the aqueous alpha-olefin sulfonate detergent composition during said bleaching.

* * * * *